US010549566B2

(12) United States Patent
Shokai

(10) Patent No.: US 10,549,566 B2
(45) **Date of Patent: *Feb. 4, 2020**

(54) IMAGE PROCESSING APPARATUS

(71) Applicants: KABUSHIKI KAISHA TOSHIBA, Tokyo (JP); TOSHIBA TEC KABUSHIKI KAISHA, Tokyo (JP)

(72) Inventor: Takeharu Shokai, Shizuoka (JP)

(73) Assignees: KABUSHIKI KAISHA TOSHIBA, Toyko (JP); TOSHIBA TEC KABUSHIKI KAISHA, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 16/201,483

(22) Filed: Nov. 27, 2018

(65) Prior Publication Data

US 2019/0092067 A1 Mar. 28, 2019

Related U.S. Application Data

(60) Division of application No. 15/828,689, filed on Dec. 1, 2017, now abandoned, which is a division of (Continued)

(30) Foreign Application Priority Data

Feb. 4, 2013 (JP) ..... 2013-019314

(51) Int. Cl.
*G03G 15/00* (2006.01)
*B41J 29/38* (2006.01)

(Continued)

(52) U.S. Cl.
CPC ..... *B41M 7/0009* (2013.01); *B41J 29/38* (2013.01); *G03G 21/00* (2013.01)

(58) Field of Classification Search
None
See application file for complete search history.

(56) References Cited

U.S. PATENT DOCUMENTS 4,763,162 A 8/1988 Yagasaki
5,966,560 A * 10/1999 Kodama ..... G03G 15/169 399/318

(Continued)

FOREIGN PATENT DOCUMENTS

JP S58-93070 6/1983
JP H08-115016 5/1996

(Continued)

OTHER PUBLICATIONS

Japanese Office Action dated Aug. 23, 2016, filed in Japanese counterpart Patent Application No. 2016-014572, 6 pages (with English translation).

(Continued)

*Primary Examiner* — Jennifer E Simmons
*Assistant Examiner* — Ruben C Parco, Jr.
(74) *Attorney, Agent, or Firm* — Kim & Stewart LLP

(57) ABSTRACT

According to embodiments, an image processing apparatus includes an erasing unit configured to perform an image erasing process on each of a plurality of conveyed recording media, and a control unit configured to control the image erasing process performed by the erasing unit. The control unit stops the image erasing process with respect to at least one of the recording media when a conveyance error occurs in the recording medium, determines a situation of the at least one of the recording media causing the conveyance error, restarts the image erasing process after the conveyance error is cleared, counts a number of the recording media conveyed to the erasing unit in accordance with a counting method according to the determined situation of the recording media, and continues the restarted image erasing process (Continued)

performed until the counted number of the recording media reaches a target number.

6 Claims, 10 Drawing Sheets

Related U.S. Application Data application No. 15/002,524, filed on Jan. 21, 2016, now abandoned, which is a continuation of application No. 14/149,419, filed on Jan. 7, 2014, now Pat. No. 9,298,154.

(51) Int. Cl.
*B41M 7/00* (2006.01)
*G03G 21/00* (2006.01)

(56) References Cited

U.S. PATENT DOCUMENTS

| | | | | |
|---|---|---|---|---|
| 7,539,633 | B1 | 5/2009 | Yamashita et al. | |
| 8,995,014 | B2 * | 3/2015 | Ishiyama | G06K 15/4065 271/145 |
| 9,298,154 | B2 | 3/2016 | Shokai | |
| 2007/0160378 | A1 | 7/2007 | Matsuda | |
| 2008/0273884 | A1 | 11/2008 | Yokobori et al. | |
| 2010/0315475 | A1 | 12/2010 | Taki et al. | |
| 2011/0205575 | A1 | 8/2011 | Karasawa | |
| 2011/0262197 | A1 | 10/2011 | Imamiya et al. | |
| 2012/0082472 | A1 | 4/2012 | Tonohiro | |
| 2012/0093525 | A1 | 4/2012 | Ota | |
| 2012/0315591 | A1 | 12/2012 | Tsuchihashi et al. | |
| 2012/0327487 | A1 | 12/2012 | Kamisuwa et al. | |

FOREIGN PATENT DOCUMENTS

| | | |
|---|---|---|
| JP | 2001-154546 | 6/2001 |
| JP | 2002-316433 A | 10/2002 |
| JP | 2003-186361 | 7/2003 |
| JP | 2007-163755 | 6/2007 |
| JP | 2009-023209 | 2/2009 |
| JP | 2011-205636 | 10/2011 |
| JP | 2012-078808 | 4/2012 |

OTHER PUBLICATIONS

Japanese Office Action dated Oct. 23, 2017, filed in counterpart Japanese Patent Application No. 2016-237865, 9 pages (with Machine translation).

* cited by examiner

IMAGE PROCESSING APPARATUS

CROSS-REFERENCE TO RELATED APPLICATIONS

This application is a division of U.S. patent application Ser. No. 15/828,689, filed on Dec. 1, 2017, which application is a division of U.S. patent application Ser. No. 15/002,524, filed on Jan. 21, 2016, now abandoned, which application is a continuation of U.S. patent application Ser. No. 14/149,419, filed on Jan. 7, 2014, now U.S. Pat. No. 9,298,154, issued on Mar. 29, 2016, which application is based upon and claims the benefit of priority from the prior Japanese Patent Application No. 2013-019314, filed on Feb. 4, 2013, the entire contents of each of which are incorporated herein by reference.

FIELD

Embodiments described herein relate generally to an image processing apparatus that has a function of erasing an image formed on a recording medium.

There is known an image processing apparatus (a so-called image forming apparatus) that forms an image on a recording medium, for example, a sheet by using a developer which may be decolored. The developer that is used in the image processing apparatus is maintained in a visible state while being colored at a temperature lower than a predetermined value, and becomes an invisible state while being decolored at a temperature equal to or higher than the predetermined value.

Further, there is known an image processing apparatus (a so-called image erasing apparatus) dedicated for an image erasing process that erases an image in a manner such that an image formed on a sheet by the image processing apparatus is heated at a predetermined temperature value or more so as to decolor the image. The sheet from which the image is erased may be reused as an image forming sheet.

Furthermore, there is also known a hybrid image processing apparatus that has an image erasing function and an image forming function.

In the image processing apparatus having the image erasing function, a user sets ten sheets having an image formed thereon on a sheet feeding cassette or an input tray of the image processing apparatus, for example, when the user wants to collectively perform an image erasing process on the ten sheets having an image formed thereon (hereinafter, referred to as image formed sheets). The user sets, for example, the erasing operation mode and the erasing number of "10" by an operation panel of the image processing apparatus. Further, the user starts the image erasing process in the image processing apparatus by operating a start key of the operation panel.

The image processing apparatus performs an image process such as an image erasing process while conveying the sheet. In the image processing apparatus, a conveyance error (a so-called jam) may occur in which the sheet is not conveyed while being jammed in a conveyance path inside the apparatus. In the event of the jam, the image processing apparatus stops an image process such as an image erasing process. The image processing apparatus resumes the stopped image process when the sheet jammed in the conveyance path inside the apparatus is removed by the user. In many cases, the removed sheet is discarded by the user.

In a case where the image processing apparatus resumes the image process after removing the sheet, the image processing apparatus resumes the image process from the state immediately before the occurrence of the jam without counting the number of the removed sheets as the number of the sheets to be subjected to the image process. For example, when the number of the sheets set to be subjected to the erasing process is "10" as described above, the erasing process is performed on the third sheet, and the jam occurs during the erasing process performed on the fourth sheet, the image processing apparatus stops the erasing process. When the fourth sheet remaining in the conveyance path inside the apparatus is removed by the user, the image processing apparatus resumes the image erasing process. Since the image processing apparatus does not count the fourth sheet as the number of the sheets to be subjected to the image erasing process, the other seven sheets with respect to the number of the sheets set to be subjected to the erasing process are fed from the sheet feeding cassette or the input tray so as to perform the image erasing process thereon.

In a case of the image erasing process, the number of the sheets that are subjected to the image erasing process by the image processing apparatus and are discharged to the outside of the apparatus finally becomes equal to the number of the sheets set to be subjected to the image erasing process, that is, ten sheets. However, the number of the sheets that are fed from the sheet feeding cassette or the input tray by the image processing apparatus becomes eleven sheets more than the number of the sheets set to be subjected to the erasing process.

Since the sheets more than the setting number of the sheets are fed, sheets different from the ten image formed sheets set in advance on the sheet feeding cassette or the input tray for the erasing process need to be also set on the sheet feeding cassette or the input tray.

When image forming sheets which do not need the image erasing process, for example, sheets on which an image is not formed are originally set on the sheet feeding cassette or the input tray, the image erasing process performed on the set sheets becomes a useless process, and hence power is uselessly consumed in the image processing apparatus.

Even when the sheets originally set on the sheet feeding cassette or the input tray are the image formed sheets, some users may desire a configuration in which the sheets more than the setting number are not fed from the sheet feeding cassette or the input tray.

DETAILED DESCRIPTION

Figure 1:
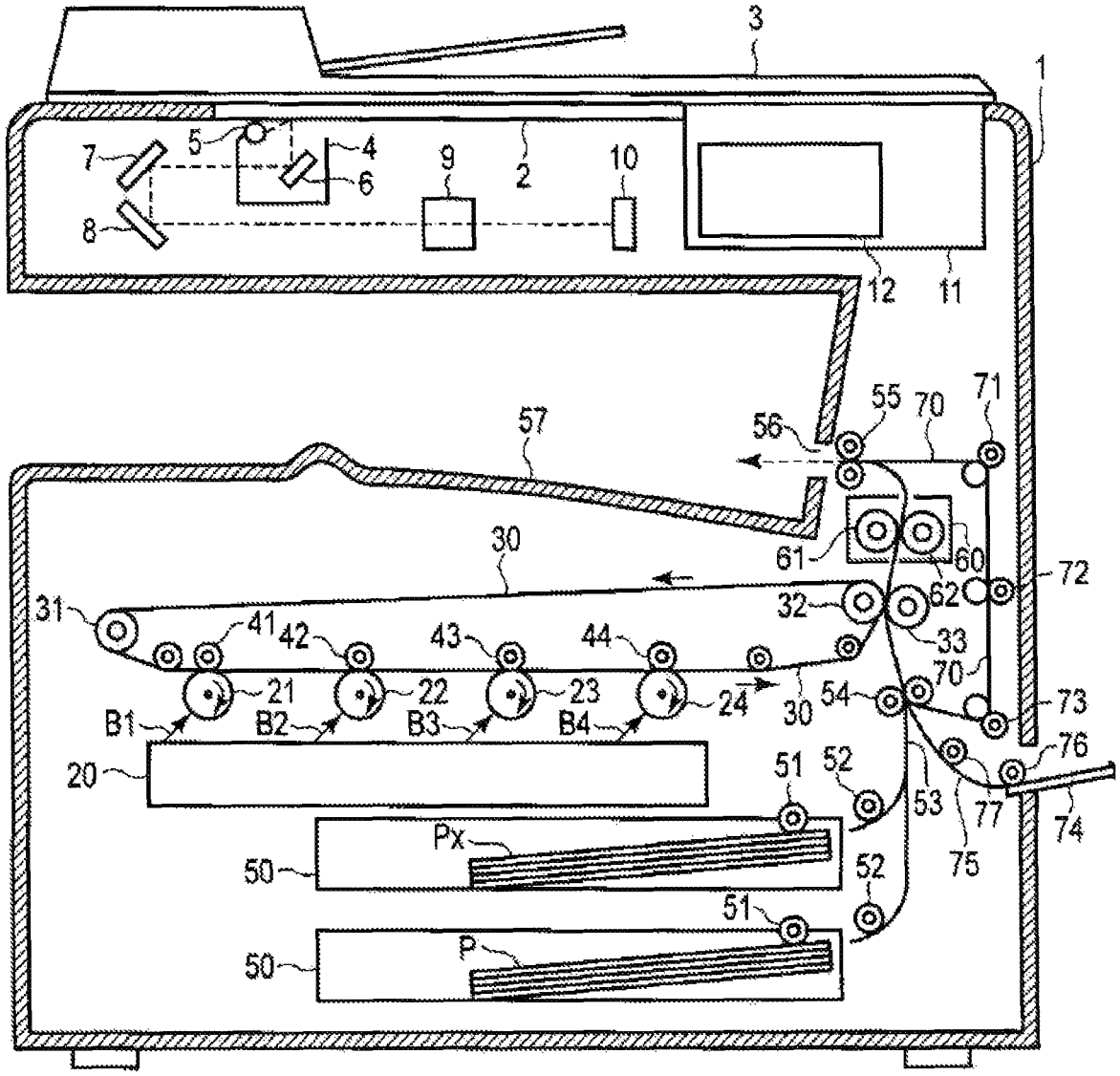
FIG. 1 is a cross-sectional view illustrating the entire configuration of an image processing apparatus according to a first embodiment.

According to embodiments, provided is an image processing apparatus that includes an erasing unit, an operation panel, and a control unit. The erasing unit erases an image formed on a conveyed recording medium. The operation panel receives the setting of the number of the recording mediums from which the image is erased. In a case where the image erasing process is stopped due to a conveyance error of the recording medium and the image erasing process is resumed, the control unit continues the image erasing process until a value obtained by counting the number of the recording mediums conveyed to the erasing unit together with the number of the recording mediums causing the conveyance error reaches a setting number.

Hereinafter, embodiments will be described further with reference to the drawings. In the drawings, the same reference numerals indicate the same or similar components.

A first embodiment will be described with reference to FIG. 1. FIG. 1 is a cross-sectional view illustrating the entire configuration of an image processing apparatus according to the first embodiment.

An image processing apparatus 1 according to the first embodiment illustrated in FIG. 1 includes an image forming mode, an image erasing mode, an image reading mode, and the like as operation modes. The image forming mode is an operation mode that may perform an image forming process in which the image processing apparatus 1 forms an image on a sheet. The image erasing mode is an operation mode that may perform an image erasing process in which the image processing apparatus 1 erases an image formed on a sheet. The image reading mode is an operation mode that may perform an image reading process in which the image processing apparatus 1 reads an image of a document. The image processing apparatus 1 performs each process of each operation mode in response to an operation in which a start key to be described later is operated by a user in each operation mode.

As illustrated in FIG. 1, the image processing apparatus 1 includes a document plate 2, a cover 3, a carriage 4, and an exposure lamp 5. The document plate 2 is disposed at the upper portion of the body of the image processing apparatus 1. The document plate 2 is formed by a transparent member, for example, a glass plate. The document plate 2 holds a document that is placed thereon by the user. The cover 3 is disposed on the document plate 2 in an openable and closable manner. The carriage 4 is disposed on the lower surface side of the document plate 2. The exposure lamp 5 is disposed in the carriage 4.

The image processing apparatus 1 includes a scanning unit 84 that reads an image of a document held by the document plate 2. The scanning unit 84 is operated in the image reading process of the image forming mode or the image reading mode. The scanning unit 84 includes reflection mirrors 6, 7, and 8, a magnification lens block 9, and a charge coupled device (CCD) 10 other than the carriage 4 and the exposure lamp 5. In the image reading process of the scanning unit 84, the carriage 4 moves along the lower surface of the document plate 2. The exposure lamp 5 exposes a document on the document plate 2 by a beam in accordance with the reciprocating movement of the carriage 4. The reflection mirrors 6, 7, and 8 lead the beam, which is reflected from the document and generated by the above-described exposure, to the magnification lens block 9. The magnification lens block 9 optically magnifies an image formed by the reflected beam and leads the image to the CCD 10. The CCD 10 outputs an image signal of a level corresponding to the reflected beam image.

The image processing apparatus 1 includes an operation panel 11 that receives the condition of each operation mode set by the user. The operation panel 11 is disposed near the document plate 2. The operation panel 11 includes a touch panel type liquid crystal display unit 12.

The image processing apparatus 1 includes an exposure unit 20. The exposure unit 20 is operated in the image forming process of the image forming mode. Based on, for example, the image signal output from the CCD 10, the exposure unit 20 emits each of a laser beam B1 corresponding to a yellow image signal, a laser beam B2 corresponding to a magenta image signal, a laser beam B3 corresponding to a cyan image signal, and a laser beam B4 corresponding to a black image signal toward each of a photosensitive drum 21 as a yellow image carrier, a photosensitive drum 22 as a magenta image carrier, a photosensitive drum 23 as a cyan image carrier, and a photosensitive drum 24 as a black image carrier.

The image processing apparatus 1 includes the photosensitive drums 21 to 24 and a transfer belt 30 as an image carrier. The photosensitive drums 21 to 24 are arranged in parallel at a predetermined interval along the transfer belt 30. In FIG. 1, the transfer belt 30 is disposed above the photosensitive drums 21 to 24. The transfer belt 30 is suspended between a drive roller 31 and a driven roller 32. The transfer belt 30 rotates in the counter-clockwise direction by the power generated from the drive roller 31.

The image processing apparatus 1 includes primary transfer rollers 41, 42, 43, and 44. The primary transfer rollers 41 to are respectively disposed at the positions facing the photosensitive drums 21 to 24 with the transfer belt 30 interposed therebetween so as to be movable up and down. The primary transfer rollers 41 to 44 are operated in the image forming process of the image forming mode. The primary transfer rollers 41 to 44 rotate while pressing the transfer belt 30 against the circumferential surfaces of the photosensitive drums 21 to 24, so that images (erasable toner images to be described later) formed on the photosensitive drums 21 to 24 are transferred to the transfer belt 30.

Figure 2:
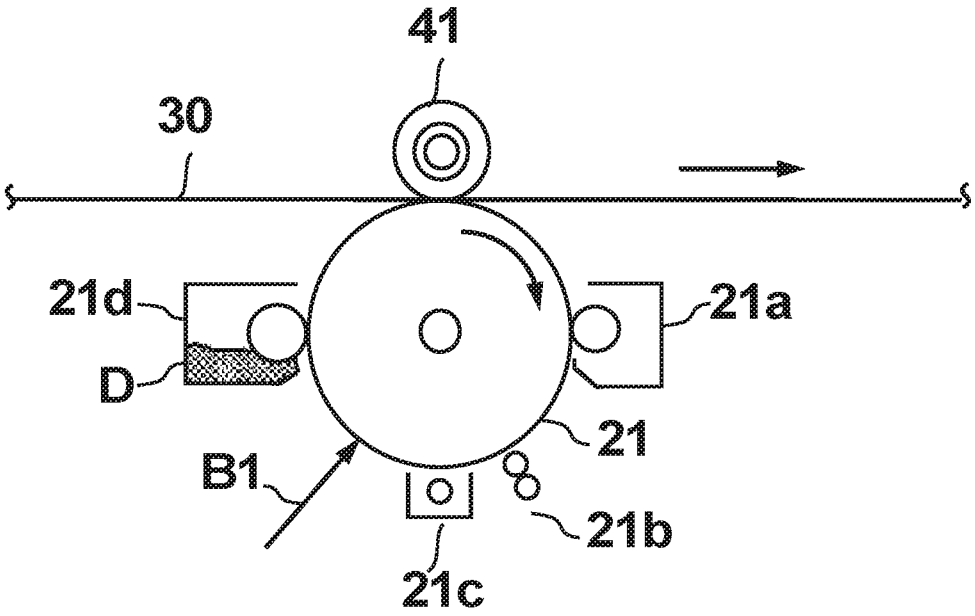
FIG. 2 is a diagram illustrating the configurations of a photosensitive drum of the image processing apparatus according to the first embodiment and the peripheral components thereof.

The configurations of the photosensitive drum 21 and the peripheral components will be described in detail with reference to FIG. 2. FIG. 2 is a diagram illustrating the configurations of the photosensitive drum 21 and the peripheral components. As illustrated in FIG. 2, the image processing apparatus 1 includes a cleaner 21*a*, a neutralizing lamp 21*b*, a charging unit 21*c*, and a developing unit 21*d*. The cleaner 21*a*, the neutralizing lamp 21*b*, the charging unit 21*c*, and the developing unit 21*d* are operated in the image forming process of the image forming mode. The cleaner 21*a*, the neutralizing lamp 21*b*, the charging unit 21*c*, and the developing unit 21*d* are disposed around the photosensitive drum 21 in this order. The cleaner 21*a* removes an erasable toner that remains on the surface of the photosensitive drum 21 after the transfer operation. The neutralizing lamp 21*b* removes a charge remaining on the surface of the photosensitive drum 21. The charging unit 21*c* uniformly charges the surface of the photosensitive drum 21 by applying a static charge to the surface of the photosensitive drum 21.

The exposure unit 20 forms an electrostatic latent image by emitting the laser beam B1 to the charged photosensitive drum 21. The developing unit 21*d* stores a yellow developer D. The developing unit 21*d* forms a yellow erasable toner image by developing the electrostatic latent image while supplying the erasable toner included in the yellow developer D to the photosensitive drum 21.

The image processing apparatus 1 also includes the cleaner, the neutralizing lamp, the charging unit, and the developing unit around the other photosensitive drums 22, 23, and 24. Since the peripheral configurations of the photosensitive drums 22 to are the same as the peripheral configuration of the photosensitive drum 21, the description thereof will not be repeated. The photosensitive drums 22, 23, and 24 form erasable toner images of respective colors of magenta, cyan, and black.

The developer D of each color is, for example, a mixture of an erasable toner and a magnetic carrier. The erasable toner is maintained in a visible state while being colored at a value lower than a predetermined temperature value, and becomes an invisible state while being decolored due to the heating at the predetermined temperature value or more. The erasable toner includes a dye and a coloring substance. The dye and the coloring substance are bonded to each other when the environmental temperature is lower than a predetermined value, for example, 120.degree. C. Due to this relation, the color of the dye becomes a visible state. The relation between the dye and the coloring substance becomes invalid when the environmental temperature is the predetermined value or more. When the relation becomes invalid, the color of the dye becomes an invisible state.

The image processing apparatus 1 includes a plurality of sheet feeding cassettes 50. The sheet feeding cassettes 50 are disposed below the exposure unit 20. The sheet feeding cassettes 50 store sheets P as subjects for the image forming process of the image forming mode. The plurality of sheet feeding cassettes store different sizes of sheets P. Among the plurality of sheet feeding cassettes 50, the sheet feeding cassette 50 that is located at the uppermost stage also serves as a sheet feeding cassette that stores sheets Px as subjects for the image erasing process of the image erasing mode.

The image processing apparatus 1 includes a pickup roller 51, a sheet feeding roller 52, and a conveyance path 53. The pickup roller 51 and the sheet feeding roller 52 are disposed for each of the plurality of sheet feeding cassettes 50. The respective pickup rollers 51 extract the sheets P and Px inside the respective sheet feeding cassettes 50 one by one. The respective sheet feeding rollers 52 feed the sheets P and Px extracted by the respective pickup rollers 51 to the conveyance path 53. The image processing apparatus 1 includes registration rollers 54, a secondary transfer roller 33, a fixing unit 60, sheet discharging rollers 55, a sheet discharging port 56, and a sheet discharging tray 57. The conveyance path 53 extends to the sheet discharging port 56 while passing through the registration rollers 54, the facing position between the driven roller 32 and the secondary transfer roller 33, the fixing unit 60, and the sheet discharging rollers 55. The sheet discharging port 56 communicates with the sheet discharging tray 57.

The sheet discharging rollers 55 discharge the sheets P and Px to the sheet discharging tray 57 through the sheet discharging port 56. In a case where the front and rear surfaces of the sheets P and Px are reversed, the sheet discharging rollers 55 are reversed when the leading ends of the sheets P and Px first exit from the sheet discharging port 56, so that the sheets P and Px are inserted (switched back) into the image processing apparatus and the sheets P and Px are supplied to a reversing unit to be described later. The sheet discharging tray 57 holds the sheets P and Px that are discharged by the sheet discharging rollers 55.

The registration rollers 54 are disposed at the upstream position in relation to the secondary transfer roller 33 in the sheet conveying direction of the conveyance path 53. The registration rollers 54 convey the sheet P that is fed by the sheet feeding roller 52 in the image forming process of the image forming mode to the secondary transfer roller 33 so as to match the rotation timing of the transfer belt 30 that carries the erasable toner image.

The secondary transfer roller 33 is disposed at the position facing the driven roller 32 with the transfer belt 30 and the conveyance path 53 interposed therebetween. The secondary transfer roller 33 transfers the erasable toner image that is transferred to the transfer belt 30 in the image forming process of the image forming mode to the conveyed sheet P. The secondary transfer roller 33 constitutes a transfer unit along with the transfer belt 30, the drive roller 31, the driven roller 32, and the primary transfer rollers 41 to 44.

The image processing apparatus 1 includes the reversing unit that reverses the front and rear surfaces of the sheets P and Px. The reversing unit includes sheet feeding rollers 71, 72, and 73 and a conveyance path 70. The conveyance path 70 extends from the termination end of the conveyance path 53 toward the upstream position in relation to the registration rollers 54 in the sheet conveying direction, and is joined to the conveyance path 53 at the upstream position. The sheet feeding rollers 71 to 73 and the conveyance path 70 guide the sheets P and Px that are switched back by the sheet discharging rollers 55 to the upstream position of the registration rollers 54.

The image processing apparatus 1 includes an input tray 74, a pickup roller 76, a sheet feeding roller 77, and a conveyance path 75. The input tray 74 is disposed on the side wall of the image processing apparatus 1 in an attachable and detachable manner. The input tray 74 holds the sheet P of the image forming subject or the sheet Px of the image erasing process subject set by the user. The conveyance path 75 extends from the input tray to the upstream position in relation to the registration rollers 54 in the sheet conveying direction, and is joined to the conveyance path 53 at the upstream position. The pickup roller 76 and the sheet feeding roller 77 are disposed along the conveyance path 75. The pickup roller 76 extracts the sheets of the input tray 74 one by one. The sheet feeding roller 77 supplies the sheet extracted by the pickup roller 76 to the upstream position of the registration rollers 54.

The fixing unit 60 is a heating unit that includes a heating roller 61 and a pressure roller 62. In the image forming process of the image forming mode, the fixing unit 60 heats the conveyed sheet Pat a first temperature, for example, 100.degree. C. lower than a predetermined value (for example, 120.degree. C.) by the heating roller 61 so that the erasable toner image transferred to the sheet P is fixed to the sheet P in a visible state. The fixing unit 60 serves as the erasing unit in the image erasing process of the image erasing mode. In the image erasing mode, the fixing unit 60 heats the conveyed sheet Px at a second temperature, for example, 130.degree. C. equal to or higher than the predetermined value by the heating roller 61 so that the image of the sheet Px is erased.

Figure 3:
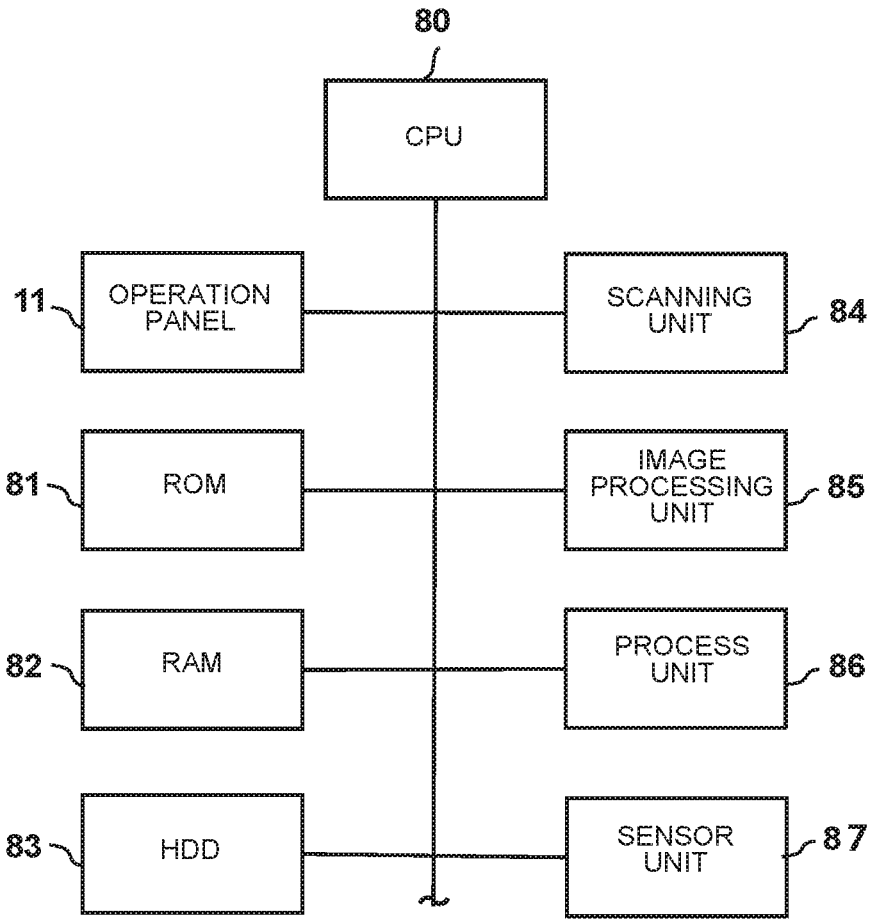
FIG. 3 is a block diagram illustrating the control configuration of the image processing apparatus according to the first embodiment.

The control configuration of the image processing apparatus 1 will be described with reference to FIG. 3. FIG. 3 is a block diagram illustrating the control configuration of the image processing apparatus 1. As illustrated in FIG. 3, the image processing apparatus 1 includes a central processing unit (CPU) as a computer, the operation panel 11, a read only memory (ROM) 81, a random access memory (RAM) 82, a hard disk drive (HDD) 83, the scanning unit 84, an image processing unit 85, a process unit 86, and a sensor unit 87. The CPU 80 is connected to the operation panel 11, the ROM 81, the RAM 82, the HDD 83, the scanning unit 84, the image processing unit 85, the process unit 86, and the sensor unit 87.

Figure 4:
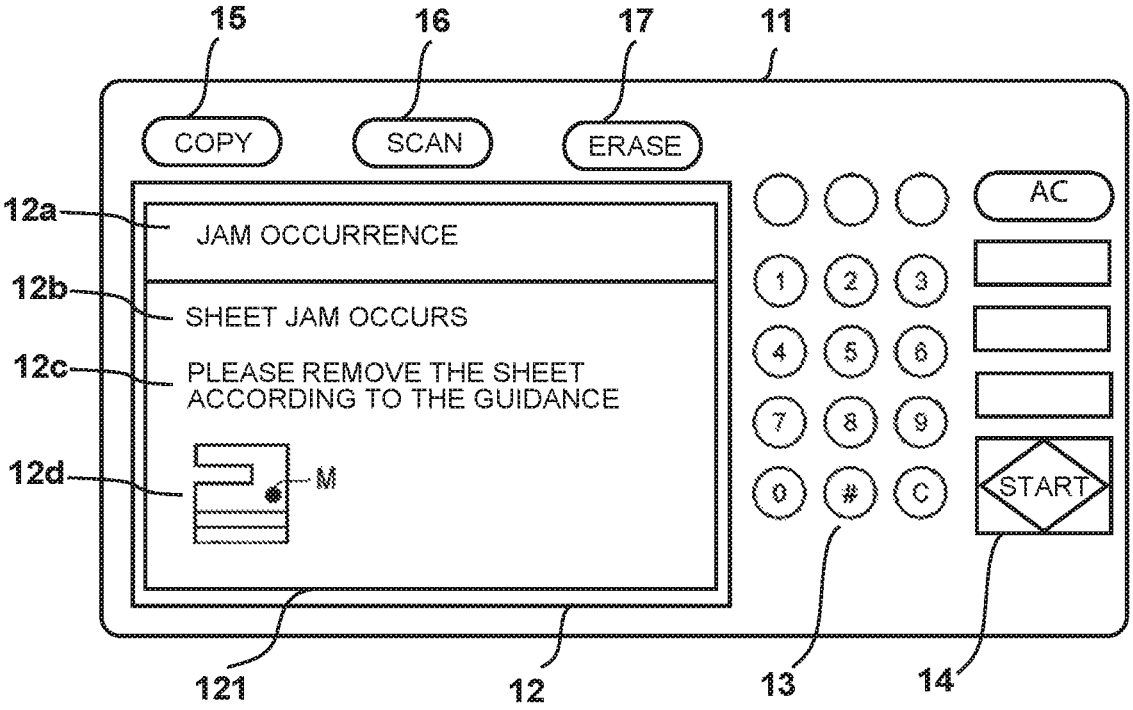
FIG. 4 is a diagram illustrating a first guide screen that is displayed on a display unit and an operation panel of the image processing apparatus according to the first embodiment.

FIG. 4 is a diagram illustrating a first guide screen 121 of the liquid crystal display unit 12 and the operation panel 11 used in the image processing apparatus 1. As illustrated in FIG. 4, the operation panel 11 includes a numeral key 13, a start key 14, a copy key 15, a scan key 16, and an erasing key 17, and the like other than the touch panel type liquid crystal display unit 12. The copy key 15 receives a user's operation for setting the image forming mode. The scan key 16 receives a user's operation for setting the image reading mode. The erasing key 17 receives a user's operation for setting the image erasing mode. The numeral key 13 receives a user's operation for setting the number of sheets to be subjected to the image erasing process and the like. The start key 14 receives a user's operation for instructing the execution of the image erasing process or the like.

The ROM 81 stores various control programs. The RAM 82 stores various data. The HDD 83 stores image data. As described above, the scanning unit 84 includes the carriage 4, the exposure lamp 5, the reflection mirrors 6 to 8, the magnification lens block 9, and the CCD 10, and reads an image of a document on the document plate 2 by optically scanning the image. The image processing unit 85 processes the image signal output from the scanning unit 84 so as to convert the image signal into an image signal suitable for forming an image.

The process unit 86 includes the exposure unit 20, the photosensitive drums 21 to 24, the transfer belt 30, the drive roller 31, the driven roller 32, the primary transfer rollers 41 to 44, the secondary transfer roller 33, the fixing unit 60, and the conveyance paths 53, 70, and 75. The process unit 86 further includes the cleaner, the neutralizing lamp, the charging unit, the developing unit, and the like disposed around the photosensitive drums 21 to 24. The process unit 86 forms an image on the sheet P based on the image signal processed by the image processing unit 85 in the image forming process of the image forming mode.

In the image erasing process of the image erasing mode, the process unit 86 erases the image formed on the sheet Px by causing the fixing unit 60 to serve as the erasing unit.

The sensor unit 87 includes a plurality of sensors that detect the positions of the sheets P and Px in the conveyance paths 53, 70, and 75. The plurality of sensors is provided at predetermined positions of the conveyance paths 53, 70, and 75. For example, the respective sensors are switched on when detecting the leading ends of the sheets P and Px and are switched off when detecting the tail ends thereof. The CPU 80 determines the positions of the sheets P and Px in the conveyance paths 53, 70, and 75 by monitoring the on and off states of the respective sensors of the sensor unit 87. Further, the CPU 80 determines a sheet jam occurrence state, a sheet jam occurrence position, and a sheet jam solving state by monitoring the on and off states of the respective sensors of the sensor unit 87.

The CPU 80 counts the number of the sheets P and Px fed from the sheet feeding cassette 50 by monitoring, for example, the on and off states of the sensor provided between the sheet feeding roller 52 and the registration rollers 54 in the conveyance path 53 among the plurality of sensors. The CPU 80 counts the number of the sheets P and Px fed from the input tray by monitoring, for example, the on and off states of the sensor provided between the sheet feeding roller 77 and the registration rollers 54 in the conveyance path 75 among the plurality of sensors. Hereinafter, a value obtained by counting the number of the sheets P and Px fed from the sheet feeding cassette 50 or the input tray 74 is referred to as a first counted value. The CPU 80 counts the number of the sheets P and Px discharged to the sheet discharging tray 57 by monitoring, for example, the on and off states of the sensor provided at a position near the sheet discharging rollers 55 in the conveyance path 53 among the plurality of sensors. Hereinafter, a value obtained by counting the number of the sheets P and Px discharged to the sheet discharging tray 57 is referred to as a second counted value.

The CPU 80 is a control unit that controls the execution of the main function of the image processing apparatus 1 based on the program inside the ROM 81. When the copy key 15 of the operation panel 11 receives the operation of the user, the CPU 80 sets the operation mode of the image processing apparatus 1 to the image forming mode.

When the start key 14 of the operation panel 11 receives the operation of the user in the image forming mode, the CPU 80 starts the execution of the image forming process of the image processing apparatus 1 so that an image is formed on the sheet P fed from the sheet feeding cassette 50 or the input tray 74. In the image forming process, the fixing unit 60 fixes the image (toner image) formed on the sheet P to the sheet P as described above.

When the erasing key 17 of the operation panel 11 receives the operation of the user, the CPU 80 sets the operation mode of the image processing apparatus 1 to the image erasing mode.

The CPU 80 starts the execution of the image erasing process of the image processing apparatus 1 so that an image formed on the sheet Px fed from the sheet feeding cassette 50 or the input tray 74 is erased when the start key 14 of the operation panel 11 receives the operation of the user in the image erasing mode. In the image erasing process, the fixing unit 60 erases the image formed on the sheet Pas described above.

When the image processing apparatus 1 starts the image forming process and the image erasing process, the CPU 80 obtains the first counted value by counting the number of the sheets fed from the sheet feeding cassette 50 or the input tray 74. When the numeral key 13 of the operation panel 11 receives the setting of the number of the sheets from the user before the start key 14 of the operation panel 11 receives the operation of the user, the CPU 80 controls the operation of the image processing apparatus 1 so that the image forming process and the image erasing process are continued until the first counted value reaches the value set for the number of the sheets.

When the image processing apparatus 1 starts the image forming process and the image erasing process, the CPU 80 obtains the second counted value by counting the number of the sheets discharged to the sheet discharging tray 57. When the jam to be described later does not occur during the image forming process and the image erasing process, the second counted value is equal to the first counted value. Accordingly, the CPU 80 may control the operation of the image processing apparatus 1 so that the image forming process and the image erasing process are continued until the second counted value reaches the value set for the number of the sheets.

A conveyance error may occur in which the sheets P and Px are jammed in the conveyance paths 53, 70, and 75 and the sheets are not conveyed during the image forming process and the image erasing process of the image processing apparatus 1. In the description below, the conveyance error is referred to as jam.

When the CPU 80 determines that the jam of the conveyed sheets P and Px occurs, the CPU sets the operation mode of the image processing apparatus 1 to an error mode. The CPU 80 controls the display unit 12 in order to notify the sheet jam occurrence state to the user and notify an action necessary for solving the jam of the sheet in the error mode. The display unit displays the first guide screen (see FIG. 4) for notifying the sheet jam occurrence state and the action necessary for solving the jam of the sheet.

The CPU 80 stops the process operation of the image processing apparatus 1 in the error mode. For example, when the jam occurs during the image forming process, the CPU 80 controls the image processing apparatus 1 so that the image forming process is stopped. Since the image forming process is stopped, the operation for the fixing process of the fixing unit 60 is stopped. When the jam occurs during the image erasing process, the CPU 80 controls the image processing apparatus 1 so that the image erasing process is stopped. Since the image erasing process is stopped, the operation for the image erasing process of the fixing unit 60 is stopped.

The sheets P and Px remain in the conveyance paths 53, 70, and 75 of the image processing apparatus 1 that stops the process. Hereinafter, the sheets that remain in the conveyance paths 53, 70, and 75 are referred to as the jam causing sheets. When the jam causing sheets P and Px are removed from the conveyance paths 53, 70, and 75 in a manner such that the user removes the jam causing sheets P and Px, the CPU 80 determines that the jam of the sheet is solved.

The CPU 80 cancels the error mode by determining that the jam of the sheet is solved, and resumes the process of the image processing apparatus 1 immediately before the occurrence of the jam of the sheet. For example, when the process of the image processing apparatus 1 immediately before the occurrence of the jam of the sheet is the image forming process, the CPU 80 controls the fixing unit 60 so that the fixing process of the fixing unit 60 is resumed. For example, when the process of the image processing apparatus 1 immediately before the occurrence of the jam of the sheet is the image erasing process, the CPU 80 controls the fixing unit 60 so that the image erasing process of the fixing unit 60 is resumed.

When the image erasing process is resumed, the CPU 80 performs a first control or a second control below. In the first control, the CPU 80 counts the number of the sheets Px conveyed to the fixing unit 60 for the image erasing process along with the number of the jam causing sheets Px, and controls the fixing unit 60 so that the image erasing process is continued until the counted value reaches the user setting number. A value obtained by counting the number of the sheets Px conveyed to the fixing unit 60 along with the number of the jam causing sheets Px is the first counted value. Accordingly, the fixing unit 60 continues the image erasing process until the first counted value reaches the user setting number.

In the second control, the CPU 80 counts the number of the sheets Px conveyed to the fixing unit 60 for the image erasing process without including the number of the jam causing sheets Px, and controls the fixing unit 60 so that the image erasing process is continued until the counted value reaches the user setting number. A value obtained by counting the number of the sheets Px conveyed to the fixing unit 60 without including the number of the jam causing sheets Px is the second counted value. Accordingly, the fixing unit 60 continues the image erasing process until the second counted value reaches the user setting number.

Further, when the error mode caused by the jam during the image erasing process is canceled, the CPU 80 controls the display unit 12 so that the user designates whether the value obtained by counting the number of the sheets Px fed from the sheet feeding cassette 50 or the input tray 74 and conveyed to the fixing unit 60 includes the jam causing sheet Px. The display unit 12 displays the second guide screen (see FIG. 6) for causing the user to designate whether the value obtained by counting the number of the sheets Px conveyed to the fixing unit 60 includes the number of the jam causing sheets Px.

When the image erasing process is resumed, the CPU 80 performs any one control of the first control and the second control in response to the designation of the user in the second guide screen.

Figure 5:
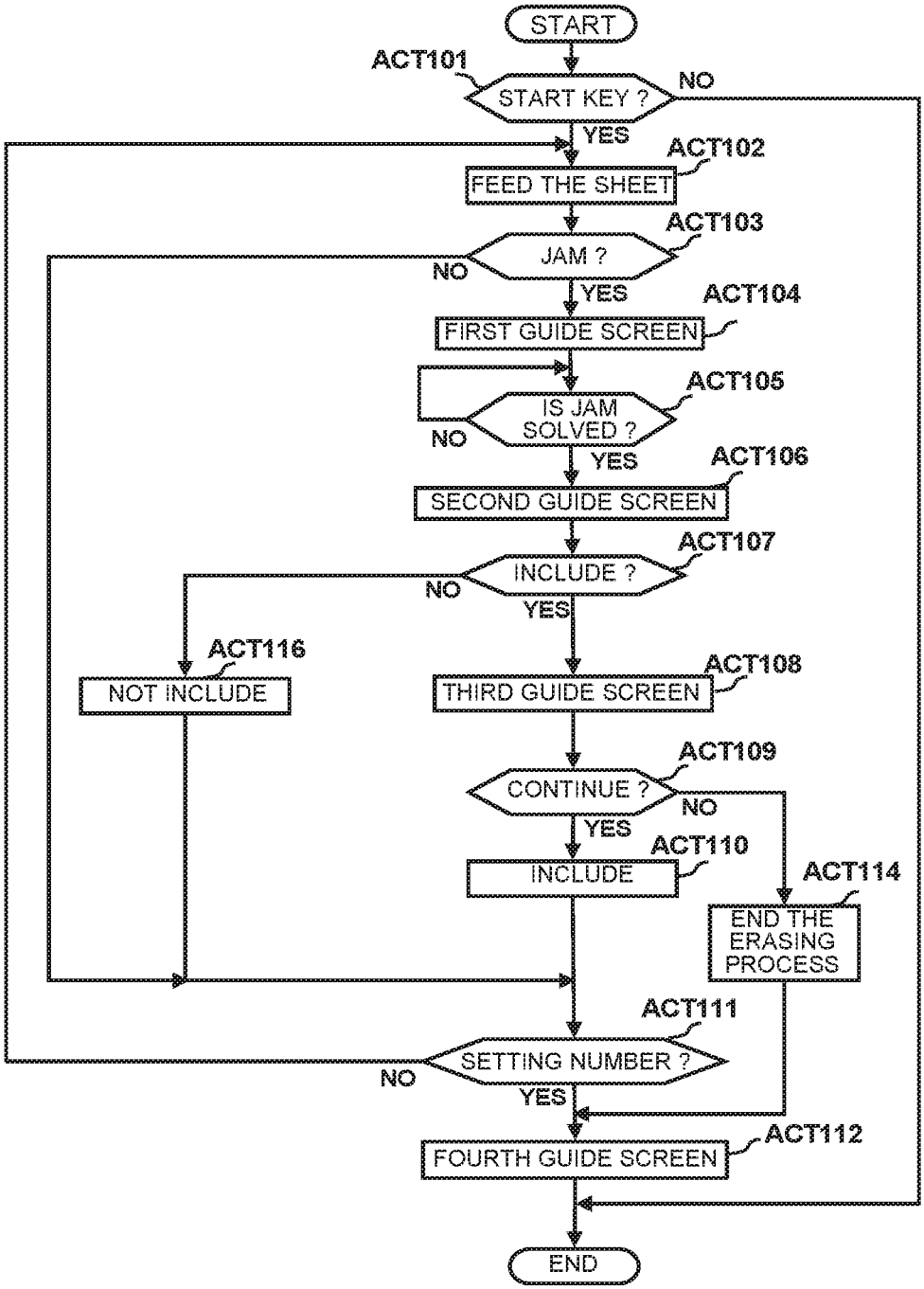
FIG. 5 is a flowchart illustrating the control operation of the image processing apparatus according to the first embodiment.

The control that is performed by the CPU 80 in the image erasing process of the image erasing mode will be described with reference to FIG. 5. FIG. 5 is a flowchart illustrating the control operation of the image processing apparatus 1. When the user wants to erase the images formed on, for example, ten sheets Px subjected to the image forming process, the ten sheets Px are set on, for example, the sheet feeding cassette 50 at the uppermost stage. Further, the user operates the erasing key 17 of the operation panel 11 in order to set the operation mode of the image processing apparatus 1 to the image erasing mode. Subsequently, the user sets the setting number of "10" corresponding to the number of the set sheets Px by operating the numeral key 13 of the operation panel 11. The CPU 80 determines whether the operation panel 11 receives the operation of the user, sets the operation mode of the image processing apparatus 1 to the image erasing mode, and receives the set sheet number.

In ACT 101, the CPU 80 determines whether the start key 14 of the operation panel 11 receives the operation of the user. When the CPU 80 determines that the start key 14 of the operation panel 11 receives the operation of the user (YES in ACT 101), the operation of the image processing apparatus 1 proceeds to ACT 102. In ACT 102, the CPU 80 starts the image erasing process by controlling the pickup roller 51 and the sheet feeding roller 52 so that the sheet Px is fed from the sheet feeding cassette 50. Specifically, the CPU 80 supplies ten sheets Px set on the sheet feeding cassette 50 to the conveyance path 53 one by one by controlling the operation of the pickup roller 51 and the sheet feeding roller 52.

In ACT 103, the CPU 80 determines the conveying position of the sheet Px in the conveyance paths 53, 70, and 75 and determines whether the jam occurs by monitoring the on and off states of the respective sensors of the sensor unit 87.

When the CPU 80 determines that the jam occurs (YES in ACT 103), the operation of the image processing apparatus 1 proceeds to ACT 104. In ACT 104, the CPU 80 controls the display unit 12 of the operation panel 11. The display unit 12 displays the first guide screen 121 illustrated in FIG. 4.

FIG. 4 is a diagram illustrating the first guide screen 121 that is displayed on the display unit 12 and the operation panel 11. As illustrated in FIG. 4, the first guide screen 121 includes a guide message 12*a* of the "jam occurrence" for notifying the occurrence of the jam and a guide message 12*b* that the "sheet jam occurs" for notifying the occurrence of the jam. The first guide screen 121 includes a guide message 12*c* of "please remove the sheet according to the guidance" for notifying the action necessary for solving the jam. The first guide screen 121 includes an image pattern 12*d* for notifying the jam occurrence position by a mark M.

The user may recognize the state where the sheet Px of the erasing process subject is jammed, the method of solving the jam, and the jam position inside the image processing apparatus 1 by looking at the first guide screen 121. In many cases, the sheet Px that is removed by the user is discarded by the user unless the sheet Px has a considerably good condition.

In ACT 105, the CPU 80 determines whether the jam is solved in a manner such that the user removes the jam causing sheet Px in the conveyance paths 53, 70, and 75 by monitoring the on and off states of the respective sensors of the sensor unit 87. When the CPU 80 determines that the jam is solved (YES in ACT 105), the operation of the image processing apparatus 1 proceeds to ACT 106. In ACT 106, the CPU 80 controls the display unit 12 of the operation panel 11. The display unit 12 displays a second guide screen 122 illustrated in FIG. 6.

Figure 6:
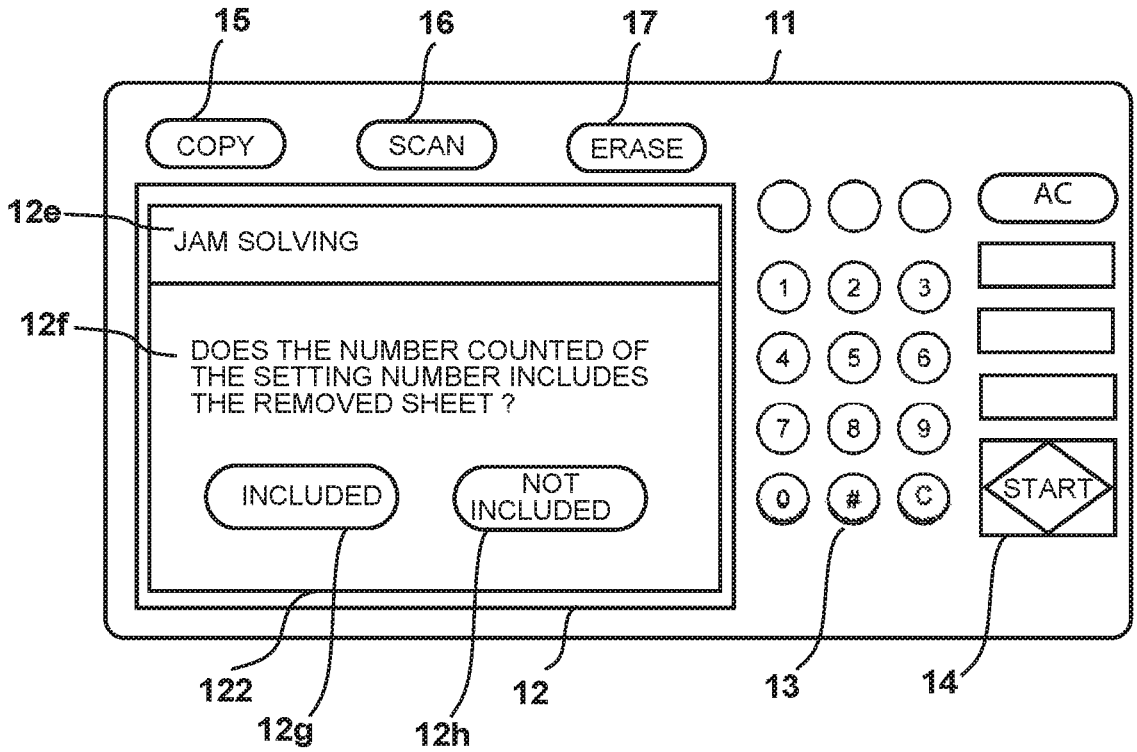
FIG. 6 is a diagram illustrating a second guide screen that is displayed on the display unit and the operation panel of the image processing apparatus according to the first embodiment.

FIG. 6 is a diagram illustrating the second guide screen 122 that is displayed on the display unit 12 and the operation panel 11. As illustrated in FIG. 6, the second guide screen 122 includes a guide message 12*e* of the "jam solving" for notifying the solving of the jam. The second guide screen 122 includes a guide message 12*f* of "does the number counted for the setting number includes the removed sheet?" for inquiring if the number of the sheets Px removed by the user is included in the value obtained by counting the number of the sheets Px conveyed to the fixing unit 60 for the image erasing process. The second guide screen 122 includes a first response key 12*g* having a response message of "included" displayed thereon and a second response key 12*h* having a response message of "not included" displayed thereon for receiving the response of the user with respect to the inquiry. The number of the sheets Px that are removed by the user when the jam is solved is equal to the number of the jam causing sheets Px.

In the second guide screen 122, the user operates the first response key 12*g* when the user wants to include the number of the jam causing sheets Px in the value obtained by counting the number of the sheets Px conveyed to the fixing unit 60. The user operates the second response key 12*h* when the user does not want include the number of the jam causing sheets Px in the value obtained by counting the number of the sheets Px conveyed to the fixing unit 60.

In ACT 107, the CPU 80 determines whether any response key of the first response key 12*g* and the second response key 12*h* receives the operation of the user. When the CPU 80 determines that the first response key 12*g* receives the operation of the user (YES in ACT 107), the operation of the image processing apparatus 1 proceeds to ACT 108. In ACT 108, the CPU 80 controls the display unit 12 of the operation panel 11. The display unit 12 displays a third guide screen 123 illustrated in FIG. 7.

Figure 7:
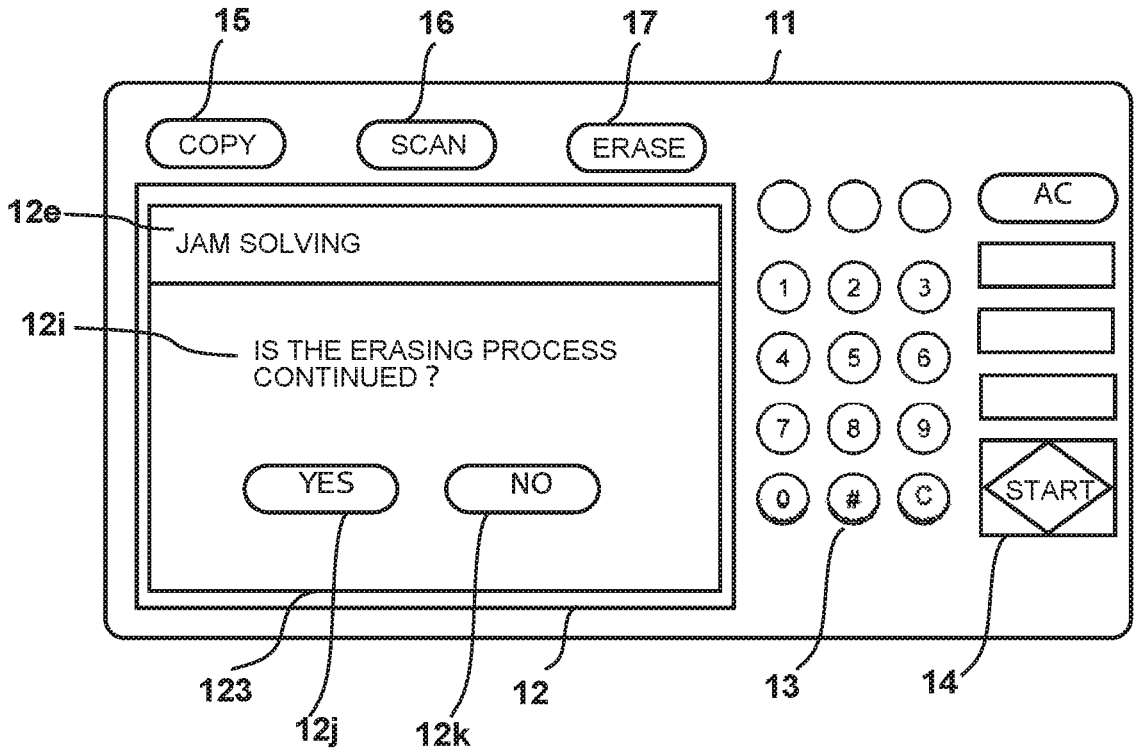
FIG. 7 is a diagram illustrating a third guide screen that is displayed on the display unit and the operation panel of the image processing apparatus according to the first embodiment.

FIG. 7 is a diagram illustrating the third guide screen 123 that is displayed on the display unit 12 and the operation panel 11. As illustrated in FIG. 7, the third guide screen 123 includes the guide message 12*e* of the "jam solving" for notifying the solving of the jam. The third guide screen 123 includes a guide message 12*i* of "is the erasing process continued?" for inquiring whether the image erasing process of the image erasing mode is continued in this way. The third guide screen 123 includes a third response key 12*j* having a response message of "YES" displayed thereon for enabling the continuation and a fourth response key 12*k* having a response message of "NO" displayed thereon for disabling the continuation.

In the third guide screen 123, the user operates the third response key 12*j* when the user wants to continue the erasing process. The user operates the fourth response key 12*k* when the user does not want to continue the erasing process.

In ACT 109, the CPU 80 determines whether any response key of the third response key 12*j* and the fourth response key 12*k* receives the operation of the user. When the CPU 80 determines that the third response key 12*j* receives the operation of the user (YES in ACT 109), the operation of the image processing apparatus 1 proceeds to ACT 110. In ACT 110, the CPU 80 counts the number of the sheets Px conveyed to the fixing unit 60 by including the number of the jam causing sheets Px. For example, the number of the sheets Px conveyed to the fixing unit 60 is counted by including the number of the jam causing sheets Px of "1". Specifically, the CPU 80 counts the number of the sheets Px conveyed to the fixing unit 60 as the first counted value. In ACT 111, the CPU 80 determines whether the first counted value as the value obtained by counting the number of the sheets Px conveyed to the fixing unit 60 for the image erasing process reaches the user setting number of "10".

When the CPU 80 determines that the first counted value does not reach the user setting number (NO in ACT 111), the operation of the image processing apparatus 1 returns to ACT 102. In ACT 102, the CPU 80 resumes the image erasing process by controlling the pickup roller 51 and the sheet feeding roller 52 so that the next sheet Px is fed from the sheet feeding cassette 50.

When the CPU 80 determines that the first counted value reaches the user setting number (YES in ACT 111), the operation of the image processing apparatus 1 proceeds to ACT 112. In ACT 112, the CPU 80 controls the display unit 12 of the operation panel 11. The display unit 12 ends the image erasing process by displaying a fourth guide screen 124 illustrated in FIG. 8.

Figure 8:
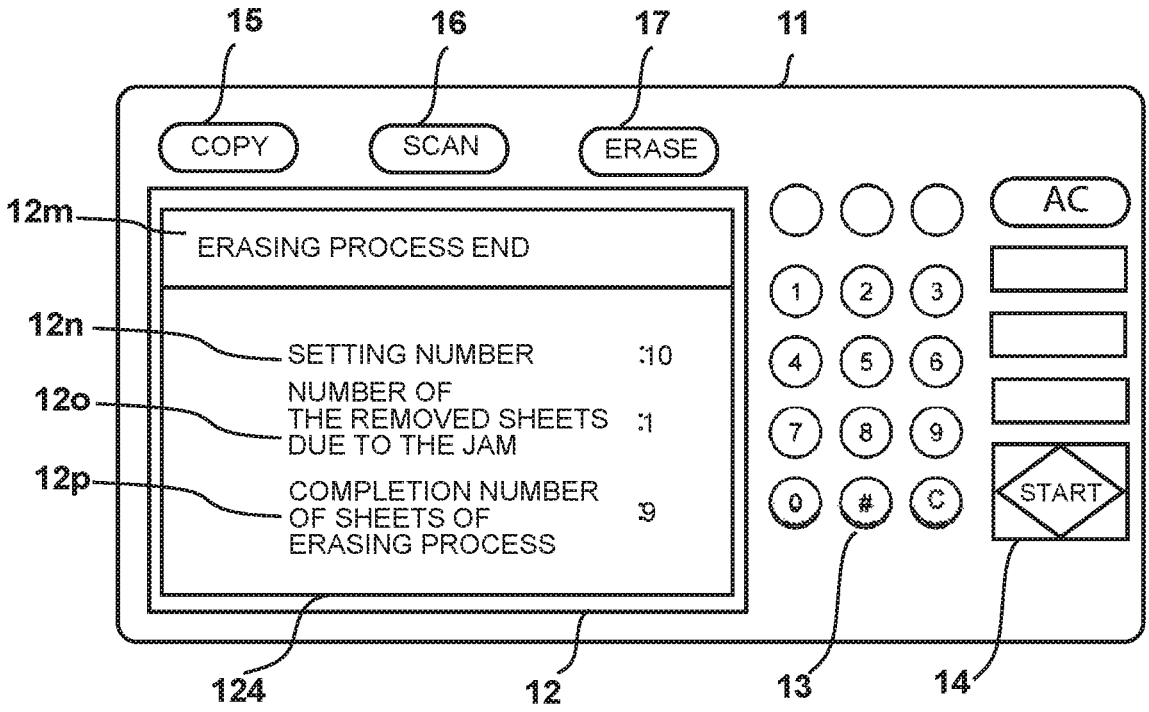
FIG. 8 is a diagram illustrating a fourth guide screen that is displayed on the display unit and the operation panel of the image processing apparatus according to the first embodiment.

FIG. 8 is a diagram illustrating the fourth guide screen 124 that is displayed on the display unit 12 and the operation panel 11. As illustrated in FIG. 8, the fourth guide screen 124 includes a guide message 12*m* of the "erasing process end" for notifying the end of the erasing process. The fourth guide screen 124 includes a first display section 12*n* having a guide message of the "setting number" for displaying the user setting number. The fourth guide screen 124 includes a second display section 12*o* having a guide message of the "number of the removed sheets due to the jam" for displaying the number of the jam causing sheets Px. The fourth guide screen 124 includes a third display section 12*p* having a guide message of the "completion number of sheets of erasing process" for displaying the number of the sheets Px subjected to the erasing process. The number of the jam causing sheets Px indicates the number of the sheets Px that are removed by the user from the inside of the image processing apparatus 1 for solving the jam. The number of the sheets Px subjected to the erasing process indicates the number of the sheets Px from which the image is removed and which are discharged to the sheet discharging tray 57.

The CPU 80 controls the display unit 12 so that the user setting number received by the numeral key 13 of the operation panel 11 is displayed on the first display section 12*n*. The CPU 80 detects the number of the jam causing sheets (the number of the sheets Px removed by the user from the inside of the image processing apparatus 1) by subtracting the second counted value from the first counted value. The CPU 80 controls the display unit 12 so that the value obtained by subtracting the second counted value from the first counted value is displayed on the second display section 12*o*. The CPU 80 controls the display unit 12 so that the second counted value is displayed on the second display section 12*o*.

The first display section 12*n* of the fourth guide screen 124 of FIG. 8 displays that the user setting number is, for example, "10". The second display section 12*o* of the fourth guide screen 124 displays that the number of the jam causing sheets Px is, for example, "1". The third display section 12*p* of the fourth guide screen 124 displays that the number of the sheets subjected to the erasing process is, for example, "9".

In the fourth guide screen 124, the user may recognize the number of the sheets Px set in advance by the display content of the first display section 12*n*. The user may recognize the number of the jam causing sheets, that is, the number of the sheets that are not subjected to the image erasing process by the display content of the first display section 12*o*. The user may recognize the number of the sheets that are subjected to the image erasing process by the display content of the first display section 12*p*.

As described above, when the number of the jam causing sheets Px is included in the value obtained by counting the number of the sheets Px conveyed to the fixing unit 60 for the image erasing process, the sheets Px that are fed from the sheet feeding cassette 50 of the uppermost stage finally become ten sheets Px set by the user. Accordingly, the image erasing process is not unnecessarily performed on the originally set sheet, for example, the image forming sheet P other than the ten sheets Px of the sheet feeding cassette 50 of the uppermost stage. The image forming sheet P indicates the sheet which does not need the image erasing process and on which the image is not formed.

Further, since it is possible to avoid the unnecessary sheet feeding operation after the jam is solved, power is not consumed uselessly in the image processing apparatus 1.

Meanwhile, in ACT 109, when the CPU 80 determines that the fourth response key 12*k* receives the operation of the user (NO in ACT 109), the operation of the image processing apparatus 1 proceeds to ACT 114. In ACT 114, the CPU 80 ends the image erasing process regardless of the value obtained by counting the number of the sheets Px fed from the sheet feeding cassette 50 and conveyed to the fixing unit 60. After the image erasing process ends, in ACT 112, the CPU 80 controls the display unit 12 of the operation panel 11. The display unit 12 displays the fourth guide screen.

For example, when the jam occurs after the fourth sheet Px is fed from the sheet feeding cassette 50 and the number of the discharged sheets Px is three, the CPU 80 controls the display unit 12 so that the user setting number received by the numeral key 13 of the operation panel 11 is displayed on the first display section 12*n* of the fourth guide screen 124. The CPU 80 controls the display unit 12 so that a value obtained by subtracting the second counted value from the first counted value is displayed on the second display section 12*o*. The CPU 80 controls the display unit 12 so that the second counted value is displayed on the second display section 12*o*. Accordingly, the first display section 12*n* displays that the user setting number is "10". The second display section 12*o* displays that the number of the jam causing sheets Px is "1". The third display section 12*p* displays that the number of the sheets subjected to the erasing process is "3".

In ACT 107, when the CPU 80 determines that the second response key 12*h* receives the operation of the user (NO in ACT 107), the operation of the image processing apparatus 1 proceeds to ACT 116. In ACT 116, the CPU 80 counts the number of the sheets Px conveyed to the fixing unit 60 for the image erasing process without including the number of the jam causing sheets Px. Specifically, the CPU 80 counts the number of the sheets Px conveyed to the fixing unit 60 as the second counted value. In ACT 111, the CPU 80 determines whether the second counted value as the value obtained by counting the number of the sheets Px conveyed to the fixing unit 60 reaches the user setting number of "10". When the CPU 80 determines that the second counted value does not reach the user setting number (NO in ACT 111), the operation of the image processing apparatus 1 returns to ACT 102. In ACT 102, the CPU 80 resumes the image erasing process by controlling the pickup roller 51 and the sheet feeding roller 52 so that the next sheet Px is fed from the sheet feeding cassette 50.

As described above, when the number of the jam causing sheets Px is not included in the counted number of the sheets Px conveyed to the fixing unit 60 for the image erasing process, the number of the sheets Px subjected to the image erasing process becomes equal to the user setting number.

When the user wants to perform the image erasing process on all sheets inside the sheet feeding cassette 50 of the uppermost stage, the number of all sheets inside the sheet feeding cassette 50 is set by the operation of the numeral key 13 of the operation panel 11. When the numeral key 13 of the operation panel 11 receives the setting number corresponding to the number of all sheets inside the sheet feeding cassette 50, the CPU 80 performs the image erasing process on all sheets inside the sheet feeding cassette 50 of the uppermost stage.

The image processing apparatus 1 according to a second embodiment will be described. In the image processing apparatus according to the second embodiment, the CPU 80 performs a third control and a fourth control instead of the first control and the second control. The CPU 80 performs the third control when the jam occurrence position of the sheet Px is a predetermined area of the conveyance paths 53, 70, and 73. In the third control, the CPU 80 controls the fixing unit 60 so that the image erasing process is continued until the first counted value as the value obtained by counting the number of the sheets Px conveyed to the fixing unit 60 for the image erasing process by including the number of the jam causing sheets Px reaches the user setting number. Accordingly, the fixing unit 60 continues the image erasing process until the first counted value reaches the user setting number.

The CPU 80 performs the fourth control when the jam occurrence position of the sheet Px is other than the predetermined area of the conveyance paths 53, 70, and 73. In the fourth control, the CPU 80 controls the fixing unit 60 so that the image erasing process is continued until the second counted value as the value obtained by counting the number of the sheets Px conveyed to the fixing unit 60 for the image erasing process without including the number of the jam causing sheets Px reaches the user setting number. Accordingly, the fixing unit 60 continues the image erasing process until the second counted value reaches the user setting number. The configuration of the image processing apparatus 1 according to the second embodiment is the same as that of the first embodiment except for the third control and the fourth control. Accordingly, in the description below, the description other than the third control and the fourth control will not be repeated.

Figure 9:
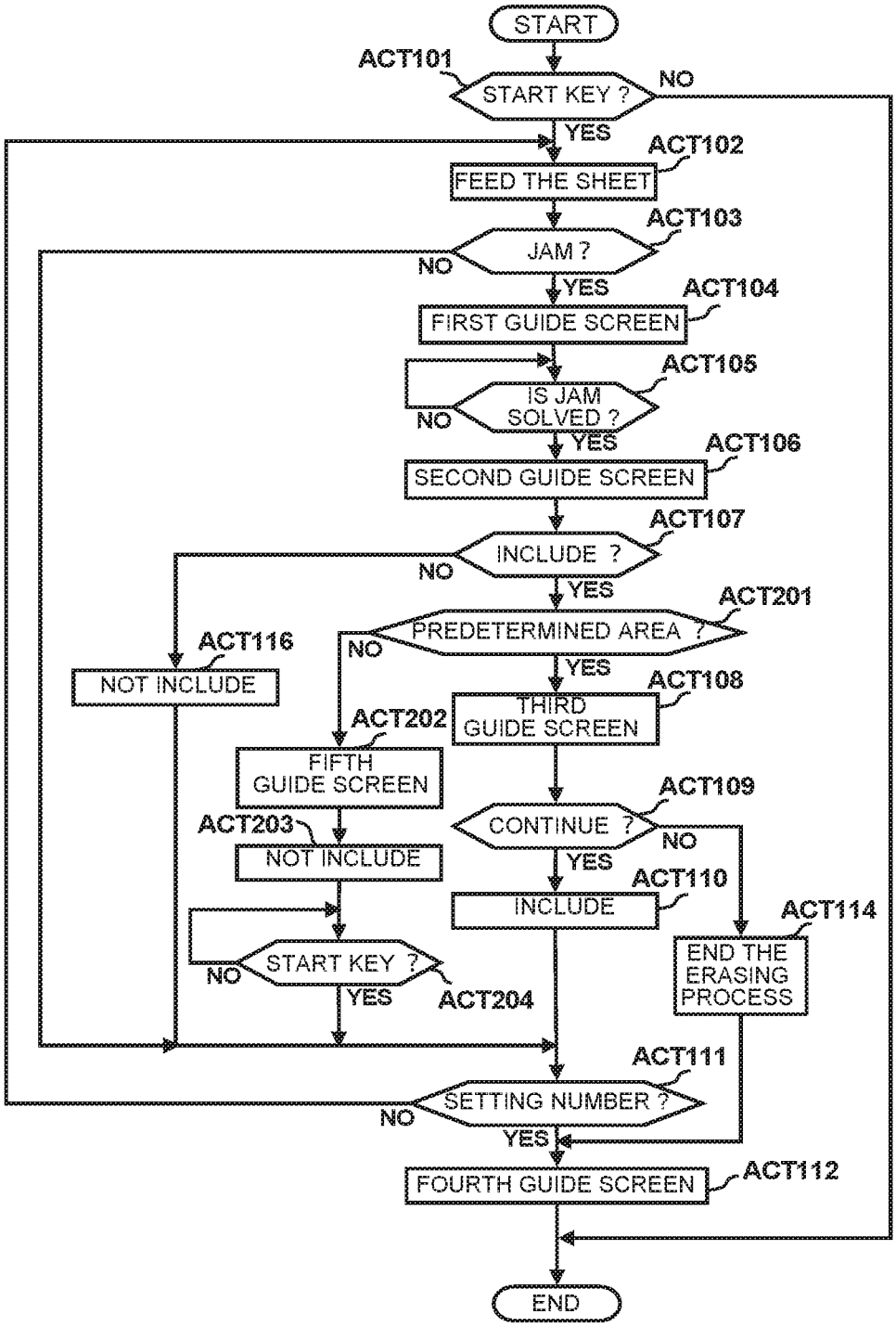
FIG. 9 is a flowchart illustrating the control operation of an image processing apparatus according to a second embodiment.

In the erasing process of the image erasing mode, the control and the revolving parts thereof different from the first embodiment among the control executed by the CPU 80 will be described with reference to the flowchart of FIG. 9. In ACT 107, when the CPU 80 determines that the first response key 12*g* receives the operation of the user (YES in ACT 107), the operation of the image processing apparatus 1 proceeds to ACT 201. In ACT 201, the CPU 80 determines whether the position of the jam causing sheet Px is the predetermined area by monitoring, for example, the on and off states of the respective sensors of the sensor unit 87.

The predetermined area is a conveyance path that has many curved portions or a conveyance path that includes a plurality of rollers for conveying the sheet. In other words, the predetermined area is an area where the jam causing sheet is likely to be damaged largely. Specifically, for example, the predetermined area corresponds to the area from the registration rollers 54 to the sheet discharging port 56 in the conveyance path 53 and the entire area of the reversing conveyance path 70.

When the CPU 80 determines that the position of the jam causing sheet Px is the predetermined area (YES in ACT 201), the operation of the image processing apparatus 1 proceeds to ACT 108. In ACT 108, the CPU 80 controls the display unit 12 of the operation panel 11. As described above, the display unit 12 displays the third guide screen 123.

In ACT 109, when the CPU 80 determines that the third response key 12*j* receives the operation of the user (YES in ACT 109), the operation of the image processing apparatus 1 proceeds to ACT 110. In ACT 110, the CPU 80 determines whether the first counted value reaches the user setting number of "10". When the CPU 80 determines that the first counted value does not reach the user setting number of "10" (NO in ACT 110), the operation of the image processing apparatus 1 returns to ACT 102. In ACT 102, the CPU 80 resumes the operation of feeding the next sheet Px as described above.

In ACT 201, when the CPU 80 determines that the position of the jam causing sheet Px is other than the predetermined area (NO in ACT 201), the operation of the image processing apparatus proceeds to ACT 202. In ACT 202, the CPU 80 controls the display unit 12 of the operation panel 11. The display unit 12 displays a fifth guide screen 125 illustrated in FIG. 10. In ACT 203, the CPU 80 counts the number of the sheets Px conveyed to the fixing unit 60 for the image erasing process without including the number of the jam causing sheets Px as in ACT 116. For example, when one sheet Px remains inside the image processing apparatus 1 due to the jam and one sheet Px is removed from the image processing apparatus 1 by the user so as to solve the jam, the CPU 80 counts the number of the sheets Px conveyed to the fixing unit 60 for the image erasing process without including the number of the sheets Px of "1". Specifically, the CPU 80 counts the number of the sheets Px conveyed to the fixing unit 60 as the second counted value.

Figure 10:
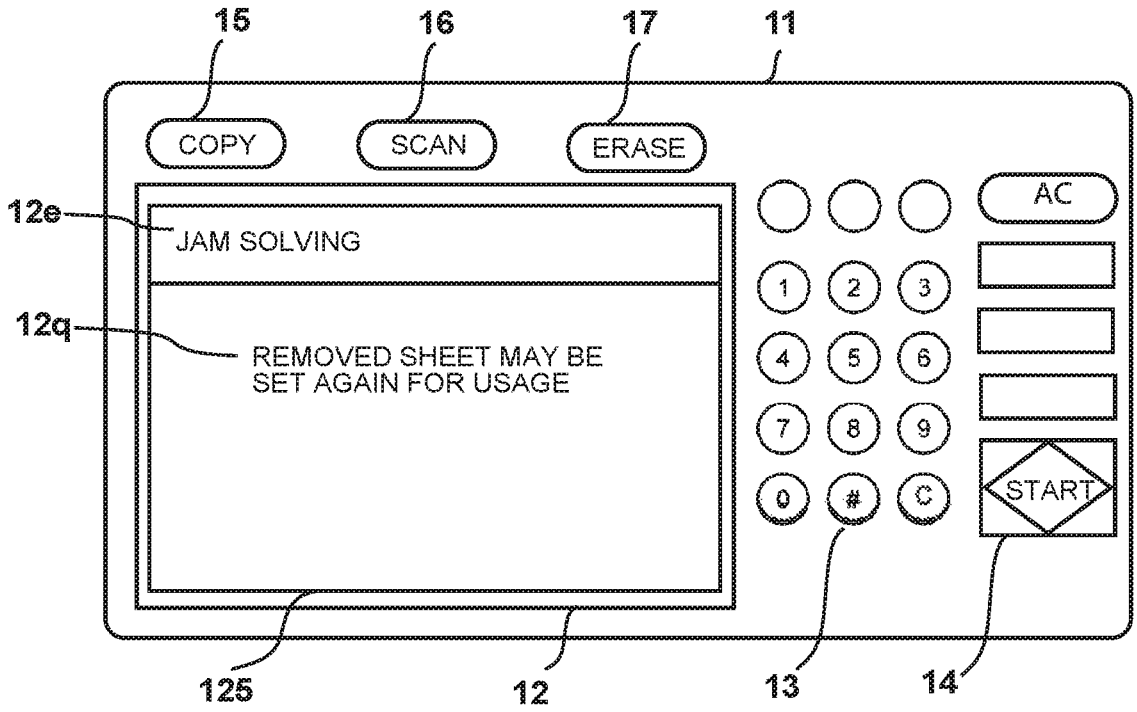
FIG. 10 is a diagram illustrating a fifth guide screen that is displayed on a display unit and an operation panel of the image processing apparatus according to the second embodiment.

FIG. 10 is a diagram illustrating the fifth guide screen 125 that is displayed on the display unit 12 and the operation panel 11. As illustrated in FIG. 10, the fifth guide screen 125 includes the guide message 12*e* of the "jam solving" for notifying the solving of the jam. The fifth guide screen 125 includes a guide message 12*q* of the "removed sheets may be set again for the usage" for notifying the possibility that the sheets removed from the image processing apparatus 1 by the user to solve the jam may be reused.

The possibility that the removed sheets may be reused indicates the possibility that the sheets Px are not damaged and hence the sheets Px may be set on the sheet feeding cassette 50 of the uppermost stage for the image erasing process.

The user recognizes the possibility that the removed sheets Px may be reused by looking at the fifth guide screen 125. When the removed sheets Px are not largely damaged in actual fact, the sheets Px are set again on the sheet feeding cassette 50 of the uppermost stage. After the sheets Px are set again, the user operates the start key 14 of the operation panel 11.

In ACT 204, the CPU 80 determines whether the start key 14 of the operation panel 11 receives the operation of the user. When the CPU 80 determines that the start key 14 of the operation panel 11 receives the operation of the user (YES in ACT 101), the operation of the image processing apparatus 1 proceeds to ACT 111. In ACT 111, as described above, the CPU 80 determines whether the second counted value reaches the user setting number of "10". When the CPU 80 determines that the second counted value does not reach the user setting number of "10" (NO in ACT 111), the operation of the image processing apparatus 1 returns to ACT 102. In ACT 102, the CPU 80 resumes the operation of feeding the next sheet Px as described above.

As described above, according to the image processing apparatus 1 of the second embodiment, it is possible to determine whether the jam causing sheet Px is largely damaged by the position of the jam causing sheet Px. When the CPU 80 of the image processing apparatus 1 determines that the jam causing sheet Px is not largely damaged, the CPU 80 counts the number of the sheets Px conveyed to the fixing unit 60 without including the number of the jam causing sheets Px. Further, the CPU 80 displays the message (the fifth guide screen 125) that urges the user to set the jam causing sheet Px on the sheet feeding cassette 50 again on the display unit 12. Accordingly, the user may effectively use the reusable sheet Px. When the sheet is used more frequently, natural resources may be saved greatly.

In the above-described embodiments, a case has been described in which the image formed sheet Px is set on the sheet feeding cassette 50 of the uppermost stage and is fed for the image erasing process. However, the position of setting the sheet Px, that is, the position of feeding the sheet Px is not limited to the sheet feeding cassette 50 of the uppermost stage, and may be the sheet feeding cassette 50 or the input tray 74 of the lower stage.

In the above-described embodiments, a configuration has been described in which the user designates whether the value obtained by counting the number of the sheets Px conveyed to the fixing unit 60 for the image erasing process includes the number of the jam causing sheets Px through the second guide screen 122 after the jam is solved. However, whether the number of the jam causing sheets Px is included in the value obtained by counting the number of the sheets Px conveyed to the fixing unit 60 may be designated in a manner such that the user initially sets any mode of the mode in which the counted number includes the jam causing sheet Px and the mode in which the counted number does not include the jam causing sheet Px instead of the method in which the image processing apparatus 1 displays the second guide screen 122.

The content of the guide message or the image pattern that is displayed on the display unit 12 of the operation panel 11 is not limited to the above-described embodiments, and may be modified into various forms. The content of the guide message or the image pattern that is displayed on the display unit 12 may be appropriately changed in response to the culture or the language in a region where the image processing apparatus 1 is installed.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. An image processing apparatus comprising:

a storing device configured to store a plurality of recording media;

an erasing device configured to erase images respectively formed on a plurality of recording media by performing an image erasing process on each recording medium conveyed from the storing device;

an operation panel including a display device and configured to receive an input of a setting; and a processor configured to:

count a number of the recording media conveyed from the storing device to the erasing device, in a case where the setting that has been input via the operation panel indicates a number of recording media to be subjected to the image erasing process, control the erasing device to continue the image erasing process until the counted number reaches the number indicated by the setting, and in a case where the setting that has been input via the operation panel specifies all of the recording media stored by the storing device to be subjected to the image erasing process, control the erasing device to perform the image erasing process on all of the recording media stored by the storing device, wherein when the setting that has been input via the operation panel indicates a number of recording media to be subjected to the image erasing process and a conveyance error occurs during the image erasing process with respect to at least one of the recording media, the processor stops the image erasing process with respect to the at least one of the recording media, controls the display device to display a guide screen that prompts an input as to whether or not to include the at least one of the recording media causing the conveyance error in counting the number of the recording media conveyed from the storing device to the erasing device, and after the conveyance error is solved and the input is made on the guide screen, controls the erasing device to continue the image erasing process until the number counted reaches the number indicated by the setting, wherein when the input is made on the guide screen to include the at least one of the recording media causing the conveyance error in counting the number of the recording media, the processor controls the display device to display another guide screen to prompt an input as to whether or not to continue the image erasing process, and when the input is made on said another guide screen to not continue the image erasing process, the processor controls the erasing device to stop the image erasing process.

2. The image processing apparatus according to claim 1, wherein the processor controls the display device to display a number of the recording media on which the image erasing process has been performed by the erasing device when the number of the recording media counted has reached the number indicated by the setting.

3. The image processing apparatus according to claim 1, wherein the operation panel has a key for receiving the input of the setting which indicates either a number of the recording media to be subjected to the image erasing process or all of the recording media stored by the storing device to be subjected to the image erasing process.

4. The image processing apparatus according to claim 1, wherein the storing device has a plurality of feeding cassettes, and the processor controls the erasing device to perform the image erasing process on all of the recording media stored in any one of the plurality of feeding cassettes in the case where the setting that has been input via the operation panel specifies all of the recording media stored by the storing device to be subjected to the image erasing process.

5. The image processing apparatus according to claim 1, wherein the storing device has an input tray, and the processor controls the erasing device to perform the image erasing process on all of the recording media held on the input tray in the case where the setting that has been input via the operation panel specifies all of the recording media stored by the storing device to be subjected to the image erasing process.

6. The image processing apparatus according to claim 1, wherein when the input is made on said another guide screen to continue the image erasing process, the processor controls the erasing device to continue the image erasing process until the number counted reaches the number indicated by the setting.

* * * * *